US009052174B2

(12) United States Patent
Dennison

(10) Patent No.: US 9,052,174 B2
(45) Date of Patent: Jun. 9, 2015

(54) TIPPED PROJECTILES

(75) Inventor: Gregory A. Dennison, Louisville, KY (US)

(73) Assignee: RA Brands, L.L.C., Madison, NC (US)

( * ) Notice: Subject to any disclaimer, the term of this patent is extended or adjusted under 35 U.S.C. 154(b) by 1190 days.

(21) Appl. No.: 12/199,306

(22) Filed: Aug. 27, 2008

(65) Prior Publication Data

US 2012/0216700 A1 Aug. 30, 2012

Related U.S. Application Data

(60) Provisional application No. 60/967,207, filed on Aug. 31, 2007.

(51) Int. Cl.

| | |
|---|---|
| ***F42B 10/46*** | (2006.01) |
| ***F42B 10/02*** | (2006.01) |
| ***F42B 10/42*** | (2006.01) |
| *F42B 12/78* | (2006.01) |

(52) U.S. Cl.

CPC ..... *F42B 10/46* (2013.01); *F42B 10/02* (2013.01); *F42B 10/42* (2013.01)

(58) Field of Classification Search

USPC ..... 102/507, 509, 521; 244/3.1

See application file for complete search history.

(56) References Cited

U.S. PATENT DOCUMENTS

| | | | | |
|---|---|---|---|---|
| 2,090,533 | A * | 8/1937 | Howdeshell | 244/3.1 |
| 3,003,420 | A | 10/1961 | Nosier | |
| 3,137,195 | A * | 6/1964 | Rosenberg, Jr. | 411/441 |
| 3,200,751 | A * | 8/1965 | Vitt | 102/519 |
| 3,732,821 | A | 5/1973 | Royer | |
| 3,865,038 | A | 2/1975 | Barr | |
| 3,911,820 | A | 10/1975 | Canon | |
| 3,949,677 | A * | 4/1976 | Voss | 102/501 |
| 3,972,286 | A | 8/1976 | Canon | |
| 3,977,629 | A * | 8/1976 | Tubeuf | 244/3.22 |
| 4,044,685 | A | 8/1977 | Avcin | |
| 4,142,467 | A * | 3/1979 | Stahlmann et al. | 102/523 |
| 4,245,557 | A | 1/1981 | Knappworst et al. | |
| 4,301,733 | A * | 11/1981 | Arciniega Blanco | 102/517 |
| 4,338,862 | A | 7/1982 | Kwatnoski et al. | |
| 4,413,564 | A * | 11/1983 | Brown | 102/501 |

(Continued)

FOREIGN PATENT DOCUMENTS

| | | |
|---|---|---|
| EP | 0578981 A1 | 1/1994 |
| FR | 2 627 273 | 8/1989 |

(Continued)

OTHER PUBLICATIONS

News and Press Releases—Winchester Ammunition, http://www.winchester.com/news/newsview.aspx?storyid=149; accessed Aug. 29, 2006; 3 pages.

(Continued)

*Primary Examiner* — Bret C. Hayes

(74) *Attorney, Agent, or Firm* — Womble Carlyle Sandridge and Rice, LLP

(57) ABSTRACT

A projectile is provided with a projectile tip having enhanced aerodynamic properties to improve accuracy of the projectile. The tip has a body having a base or lower end, an upper end and a curved, side wall between its upper and lower ends that defines an ogive tip length. The tip is received with a projectile jacket and also can have a series of aerodynamic features formed in its body to modify air flow about the body of the projectile in flight.

11 Claims, 7 Drawing Sheets

(56) References Cited

U.S. PATENT DOCUMENTS

| | | | | |
|---|---|---|---|---|
| 4,716,835 | A | 1/1988 | Leemans | |
| 5,097,767 | A | 3/1992 | Cirillo | |
| 5,101,732 | A | 4/1992 | Schluckebier | |
| 5,127,332 | A | 7/1992 | Corzine et al. | |
| 5,208,424 | A | 5/1993 | Schluckebier et al. | |
| 5,333,552 | A | 8/1994 | Corzine et al. | |
| 5,385,100 | A | 1/1995 | Corzine et al. | |
| 5,385,101 | A | 1/1995 | Corzine et al. | |
| 5,440,994 | A | 8/1995 | Alexander | |
| 5,760,329 | A | 6/1998 | Baum et al. | |
| 5,880,398 | A | 3/1999 | Crilly et al. | |
| 5,932,836 | A * | 8/1999 | White | 102/529 |
| 6,178,890 | B1 | 1/2001 | Burczynski | |
| 6,186,071 | B1 | 2/2001 | Fry | |
| 6,305,292 | B1 | 10/2001 | Burczynski et al. | |
| 6,405,654 | B1 | 6/2002 | Smith | |
| 6,526,893 | B2 | 3/2003 | May et al. | |
| 6,530,328 | B2 | 3/2003 | Burczynski et al. | |
| 6,546,875 | B2 * | 4/2003 | Vaughn et al. | 102/507 |
| 6,629,485 | B2 * | 10/2003 | Vaughn et al. | 86/55 |
| 6,736,070 | B2 | 5/2004 | Baltos | |
| 6,752,084 | B1 | 6/2004 | Husseini et al. | |
| 6,792,869 | B2 | 9/2004 | Pi | |
| 6,837,165 | B2 | 1/2005 | Eberhart et al. | |
| 6,845,716 | B2 | 1/2005 | Husseini et al. | |
| 6,964,232 | B2 | 11/2005 | Eberhart et al. | |
| 7,013,810 | B1 | 3/2006 | Brydges-Price | |
| 7,171,905 | B2 * | 2/2007 | Hirt et al. | 102/509 |
| 7,380,502 | B2 | 6/2008 | Emary | |
| 2001/0013299 | A1 | 8/2001 | Husseini et al. | |
| 2001/0050020 | A1 | 12/2001 | Davis et al. | |
| 2002/0020324 | A1 | 2/2002 | Burczynski et al. | |
| 2002/0152915 | A1 * | 10/2002 | Vaughn et al. | 102/507 |
| 2004/0129165 | A1 | 7/2004 | Cesaroni | |
| 2005/0066845 | A1 | 3/2005 | Eberhart et al. | |
| 2005/0126422 | A1 | 6/2005 | Lamm | |
| 2006/0011087 | A1 | 1/2006 | Husseini et al. | |
| 2006/0027131 | A1 * | 2/2006 | Byer | 102/521 |
| 2006/0124022 | A1 | 6/2006 | Eberhart et al. | |
| 2006/0144280 | A1 * | 7/2006 | Hirt et al. | 102/509 |
| 2006/0278117 | A1 | 12/2006 | Emary | |
| 2007/0131130 | A1 | 6/2007 | Stock, Jr. et al. | |
| 2007/0131131 | A1 | 6/2007 | Stock, Jr. et al. | |
| 2008/0196616 | A1 * | 8/2008 | Cziglenyi | 102/439 |

FOREIGN PATENT DOCUMENTS

| | | |
|---|---|---|
| GB | 21 522 | 10/1910 |
| GB | 06022 | 4/1916 |
| GB | 125 524 | 7/1984 |
| WO | WO 2009-061545 | 5/2009 |

OTHER PUBLICATIONS http://www.hornady.com/media/2006catalog/Hornady_Bullets_Rifle_Vmax.pdf#search=%22hornady%20V-max%20tip%22.

http://www.rifleshootermag.com/ammunition//index2.html.

Photograph of tipped projectiles dated Jul. 20, 2007.

"TheSentry Bullet", full color advertising flyer, New Generation Ammunition, Hennopsmeer, Republic of South Africa.

"Extreme Shock: Match-Grade AntiTerrorist Munitions Lead-Free Tungsten-NyTrilium Composite", full color catalog, Extreme Shock USA, Clintwood, Virginia, U.S.A.

http://www.extremeshockusa.com/cgistore/store.cgi?pabe=/new/catalog.html&setup-1&ida-48&idp=0&his=0&cart.

http://www.dansammo.com/nga.asp.

International Search Report and Written Opinion for PCT/US08/074581 (Issued Jul. 21, 2009).

* cited by examiner

TIPPED PROJECTILES

CROSS-REFERENCE TO RELATED APPLICATIONS

This application claims priority to and the benefit of U.S. Provisional Application No. 60/967,207, entitled PROJECTILES, filed Aug. 31, 2007, which application is incorporated herein by reference in its entirety.

TECHNICAL FIELD

The present invention generally relates to tipped projectiles having enhanced aerodynamic properties.

BACKGROUND

Tips for projectiles have been conventionally employed to enhance the appearance of the projectile to which they are attached as well as allow for a smaller and more durable meplat (i.e., the tip or nose of a bullet) diameter. The shape of the meplat is important when determining how the bullet will move through air, and certain desirable characteristics of the meplat can be achieved by forming the projectile into an ogive profile.

Conventional projectiles typically allow for an increased ballistic coefficient and a balance of the aerodynamic versus inertial forces of the projectile to try to optimize the projectile for long range precision flight. Conventional tips further typically have essentially the same geometry of the mating surface of the projectile (curvature radius) which permits the extension of the ogive curvature to a controlled termination in a smaller meplat diameter than can typically be formed by the use of the projectile jacket only. If the tip is constructed of a lighter material than the projectile jacket or core, then the center of gravity of the projectile is also moved substantially rearward given the heavier weight of the core and the corresponding geometry.

SUMMARY

Briefly described, the present invention generally is directed to projectiles and a tip therefore, such as for use in a round of ammunition. The projectile tip is designed to facilitate and/or accomplish a modification of the aerodynamic forces acting on a projectile to which the tip is mounted while in flight. The surface of the tip modifies the aerodynamic forces and where those forces act on the projectile by tailoring/manipulating the location of the center of pressure acting on the projectile versus the center of gravity of the projectile through the use of aerodynamic features that alter the air flow over the ogive portion of the projectile.

The projectile generally includes a core typically formed from a metal or similar heavy, dense material, and which is surrounded by a projectile jacket. Alternatively, the projectile can include a substantially solid, one-piece body or jacket without an additional core. The projectile jacket generally has a base or lower end, a curved and/or tapering upper end defining an opening through which the core is received, and a substantially cylindrical side wall. A tip having an axisymetric body is received within the upper end of the jacket, over the core, with the tip generally being formed from a substantially lightweight material such as a plastic, synthetic, composite or even some lightweight metal materials. The tip generally includes a first end or base adapted/received within the opening defined by the upper end of the jacket, with the upper end of the jacket generally engaging and holding a rim of the base or first end of the tip therewithin, and a second or front end that tapers towards a generally pointed nose that further can be flattened at its end.

The ogive portion of the projectile is defined between the upper end of the projectile jacket and the nose at the front end of the tip, beginning approximately at a point along the jacket where the upper end of the jacket begins to curve and/or taper inwardly, matching the taper of the second or upper end of the tip. According to one aspect of the invention, the ogive tip length of an ogival portion of the tip of the projectile may be approximately more than one-half of the ogive axial length of the entire ogive portion of the projectile, which is defined as the longitudinal distance between the point at which the upper section or end of the jacket begins to curve inwardly, i.e., where the ogive portion begins, and the flat end of the nose of the tip, thus defining the axial or total length of the ogive portion of the projectile itself as measured along a longitudinal axis extending through the projectile.

Additionally, a series of aerodynamic features will be formed in and/or along the body of the tip for modifying the aerodynamic forces acting on the projectile. The aerodynamic features generally are designed to tailor/manipulate the location of the center of pressure acting on the projectile by altering the air flow over the ogive portion of the projectile. As a result, the center of pressure can be moved relative to the center of gravity of the projectile as needed to help stabilize the projectile during flight. Such aerodynamic features can include a series of spaced slots, cuts, notches, openings, ports or other, similar features formed about the body of the tip and adapted to modify the air flow over/about the projectile. Typically, the ports or other aerodynamic features can have an opening at an upper end thereof and will extend along the length of the body into communication with an interior chamber defined within the body of the tip. The tip further can be formed with flattened sections or grooves, or with additional aerodynamic features, alone or in combination, as needed to optimize the aerodynamics and stability of the projectile for precision flight.

Those skilled in the art will appreciate the above stated advantages and other advantages, features and benefits of various additional embodiments reading the following detailed description of the embodiments with reference to the below-listed drawing figures.

BRIEF DESCRIPTION OF THE DRAWING FIGURES

According to common practice, the various features of the drawings discussed below are not necessarily drawn to scale. Dimensions of various features and elements in the drawings may be expanded or reduced to more clearly illustrate the embodiments of the invention.

DETAILED DESCRIPTION

Figure 1:
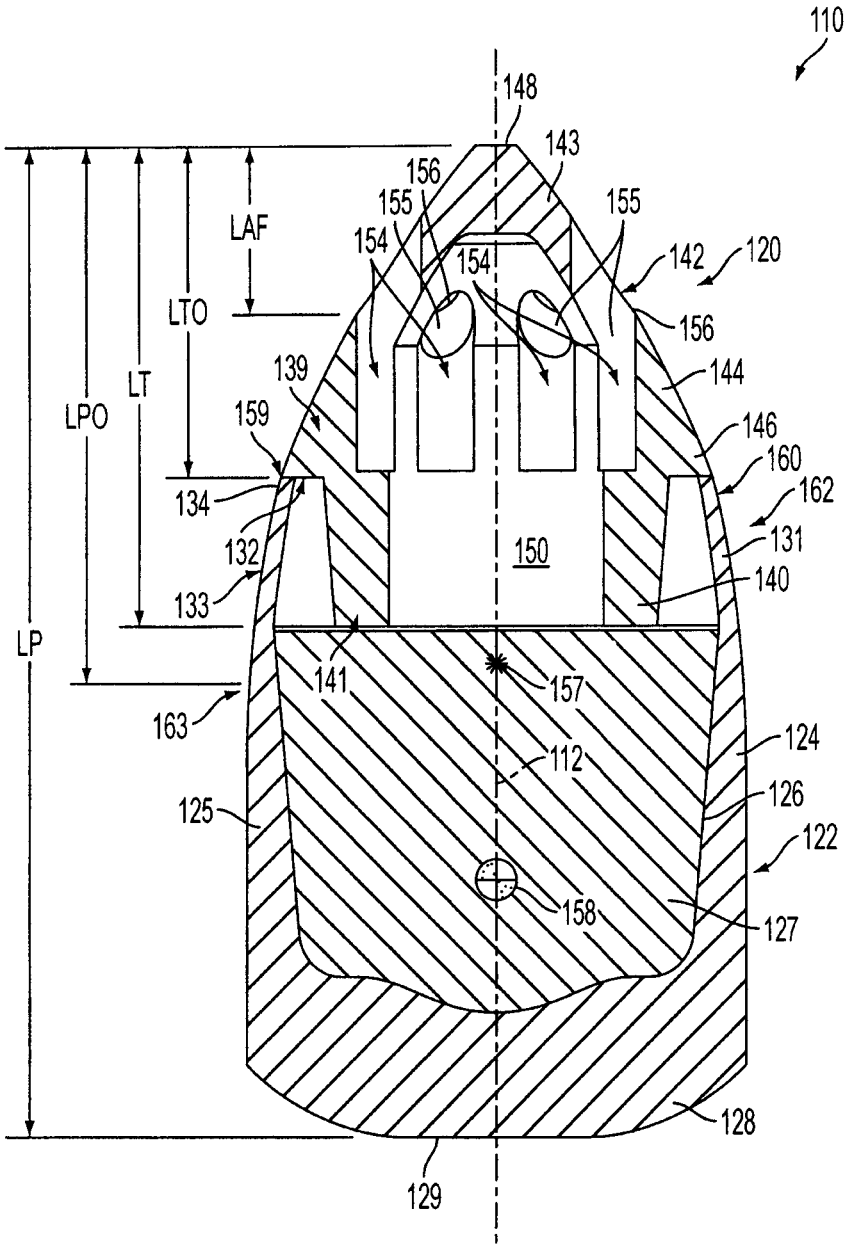
FIG. 1 is a cross sectional view of a projectile according to a first embodiment of the invention.
Figure 2:
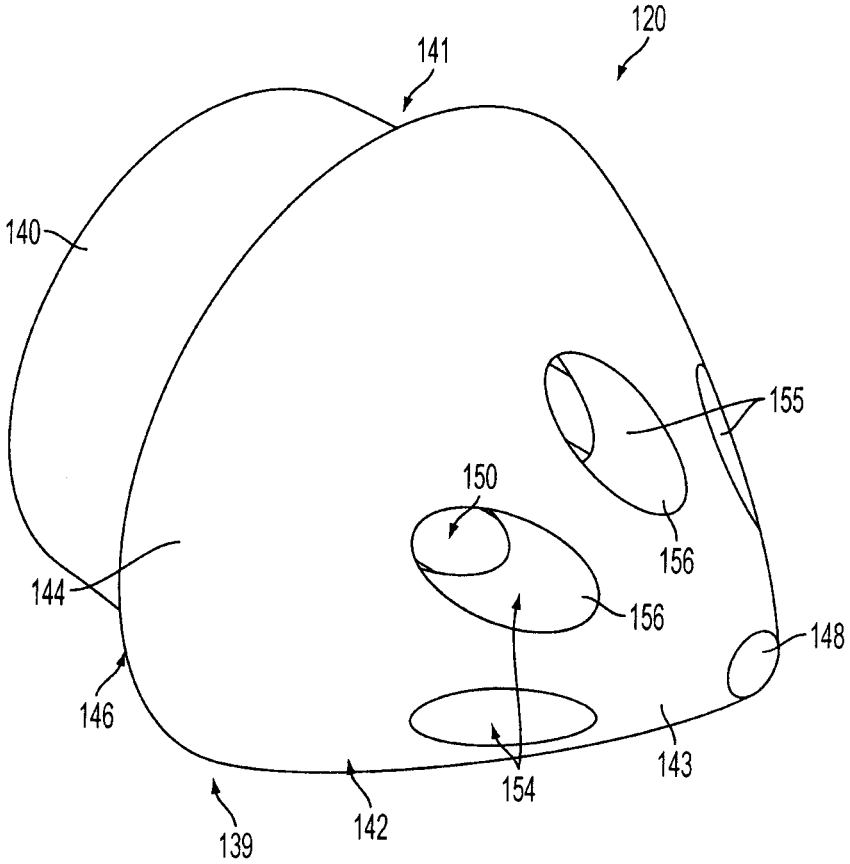
FIG. 2 is a perspective view of the tip of the projectile, separate from the projectile jacket.

Referring now to the drawings in which like numerals indicate like parts through the several views, FIGS. 1-4 generally illustrate a projectile 110 with enhanced aerodynamic properties for providing improved accuracy for heavier payloads or projectiles over increased distances according to a first embodiment of the invention. The projectile 110 comprises a tip 120 typically mounted in a projectile body or a projectile jacket 122. The projectile 110 may be axisymmetric or substantially axisymmetric about a longitudinal axis 112 and can be formed in various calibers or sizes. FIGS. 5-6 and 7A-7B illustrate still further embodiments of the projectile and tip therefore according to the principles of the present invention.

Figure 3A:
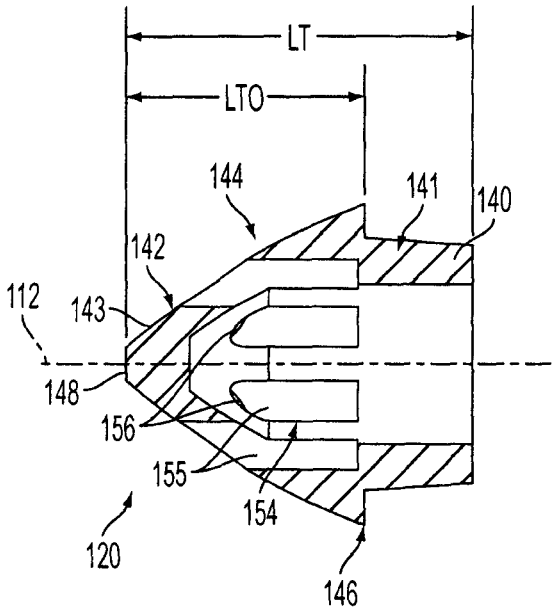
FIG. 3A is a cross sectional view of the tip of the projectile of FIG. 1.
Figure 3B:
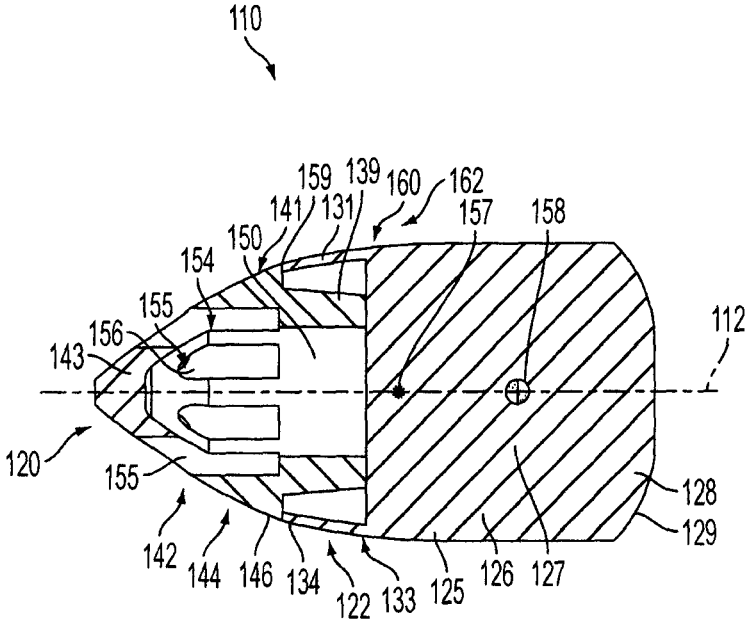
FIG. 3B is a cross sectional view showing the projectile of FIG. 1 with a one-piece body or jacket.

As indicated in FIGS. 1 and 3B, the projectile body or jacket 122 typically will be formed from a metal or metal alloy, such as copper, brass, etc., although other durable, dense materials, such as various composites or synthetic materials also can be used. The jacket further has a generally cylindrically shaped, annular body 124 with a side wall 125 that further define an interior cavity 126 as shown in FIG. 1. The interior cavity 126 can be wholly or partially filled with, for example, a projectile core 127, that, similar to the jacket, also can be formed of a metal or a metal alloy, for example, such as lead, bismuth, etc., or other heavy, dense materials. Alternatively, as shown in FIG. 3B, the jacket can be formed with a one-piece or a substantially solid projectile body without requiring a separate core. The jacket 122 (FIG. 1) additionally will have a first end or a base 128, which can have a substantially flat surface 129, and an upper end 131 defining an opening 132 in the upper end of the jacket and having a curved ogive peripheral contour 133 tapering toward a rim or upper edge 134.

As the cross-sectional view of FIG. 1 further generally illustrates, the tip 120 has a generally axisymmetric body 139 having a stem 140 projecting from a first or rear end portion 141 and being received within a front portion of the interior cavity 126 of the jacket 122, and a second or front end 142 that tapers inwardly to form a generally pointed end or nose 143. An ogival portion 144 of the tip 120 is defined between the first and second ends 141/142 of the tip, generally extending from a rim 146 to a flat front end 148 of the nose 143. As further shown in FIGS. 1-3B, the lower surface of the rim 146 generally is circumscribed about the upper end of the stem 140 and abuts/engages the forward surface of the rim 134 of the upper end of the jacket. The stem 140 may be a hollow, generally annular body, and can in part define an interior volume or chamber 150 that extends from the core 128 to the forward end of the tip 120.

A series of aerodynamic features 154 are formed in the ogival portion 144 of the tip body for enhancing the flight and aerodynamics of the tip and thus the projectile. Such aerodynamic features can include a variety of ports, openings, cuts, slots, slits, notches, concentric rings or ridges, or other features and/or combinations thereof, which modify the air flow over and about the surface of the tip and thus about the projectile itself during flight. In the embodiment of FIGS. 1-4, a plurality of ports 155 are shown. The ports 155 can extend from a forward, open end 156 on the surface of the ogival portion 144 along the body 139 and into the interior volume 150 of the tip. The aerodynamic features help tailor or manipulate the location of a center of pressure 157 (FIG. 1) for the projectile, relative to the center of gravity 158 of the projectile as needed to help stabilize the projectile in flight. As shown in FIG. 1, the center of gravity 158 of the projectile generally is located within the core 127, along the longitudinal axis 112 and toward the base 128 of the projectile jacket. By modifying the airflow passing over the tip, and thus the projectile, with the aerodynamic features, the center of pressure 157 of the projectile can be moved relative to the center of gravity 158 of the projectile by a distance or length sufficient to help stabilize the projectile in flight and resist tumbling to improve the accuracy thereof. The location of the center of pressure can further be manipulated along the longitudinal axis by changing the location and/or the geometry of the aerodynamic features on the ogive.

The tip 120 can be held in place in the jacket by deforming the upper edge or rim 134 of jacket 122 inwardly against the rim 146 of the tip, as discussed in further detail below. The ogival portion 144 of the tip 120 along with a jacket ogival portion 160 of the jacket 122 comprise the overall projectile ogive portion 162 of the projectile 110.

The tip 120 is further configured to assist in tailoring the aerodynamic properties of the projectile 110. In the embodiment shown in FIG. 1, the tip 120 has a tip length LT extending between the end of the stem and the flat front end of the nose, as measured along longitudinal axis 112, and its ogival portion 144 generally has a ogive tip length LTO defined as the longitudinal distance between the point 159 where the rim 146 of the tip 120 engages the upper edge 134 of the jacket and the flat end 148 of the nose 143 of the projectile 110 as measured along longitudinal axis 112. The projectile 110 has an overall length LP and an ogive axial length LPO of the ogive portion 162, which is generally defined as the length or distance between the flat end 148 of the nose 143 and a point 163 at which the ogival portion 160 of the jacket begins, as measured along the longitudinal axis 112. According to one aspect of the invention, the tip is constructed as having an ogive tip length LTO that is more than one half the ogive axial length LPO of the projectile 110. The external aerodynamic features 154 formed along the ogive of the projectile further help cause the projectile 110 to behave in a more stable manner during flight, resulting in improved accuracy.

FIG. 3A is a cross sectional view generally illustrating the tip 120. In this example embodiment, the length LT of the tip 120 can be about 0.545 inch and can range from about 0.4-0.6 inches. The ogive tip length LTO of the tip 120 can be about 0.375 inches and can range from about 0.15 inches to about 0.5 inches, while the ogive axial length can range from about 0.25 to about 0.95 inches. The overall length LP of the projectile further can be about 0.75 inches to about 1.175-2 inches. It also will be understood by those skilled in the art that further changes or variations to such dimensions or lengths can also be utilized depending on caliber, size and configuration of the projectile.

Figure 4:
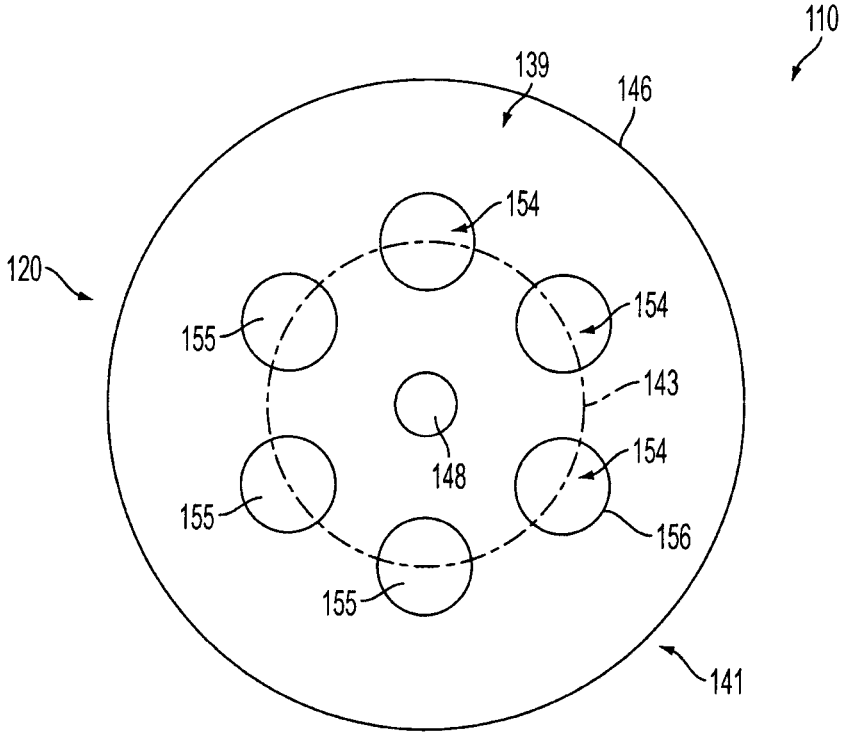
FIG. 4 is an end view of the tip.

FIG. 4 is an end view of the tip 120. In the exemplary embodiment, the tip 120 includes six ports 155 spaced at sixty degree increments around a forward perimeter of the tip. Referring also to FIG. 3, the ports 154 generally can be formed in the tip 120 so that they extend parallel to a longitudinal axis of the tip. Additionally, while six ports 155 are shown in the illustrated embodiment, fewer (i.e., 2-5) or greater numbers of ports, and/or other, varying features also can be used.

The tip 110 further can be made in a variety of colors, and can be formed from a variety of lightweight, durable materials such as, for example, plastics, such as polycarbonate, various synthetics or composite materials and even lightweight metal or metal alloy materials. The tip also can be secured in the jacket 122 by, for example, forming longitudinal or spiral nose cuts 164 (FIGS. 7A-7B), notches, indentations, or other, similar attachment features, about the rim 134 of the jacket and pressing portions of the jacket 122 or projectile body defined by such spiral nose cuts, etc., inwardly against the tip, by crimping or press fitting the rim 134 of the jacket against the rim of the tip as indicated in FIG. 7C, or by various other means.

Figure 5:
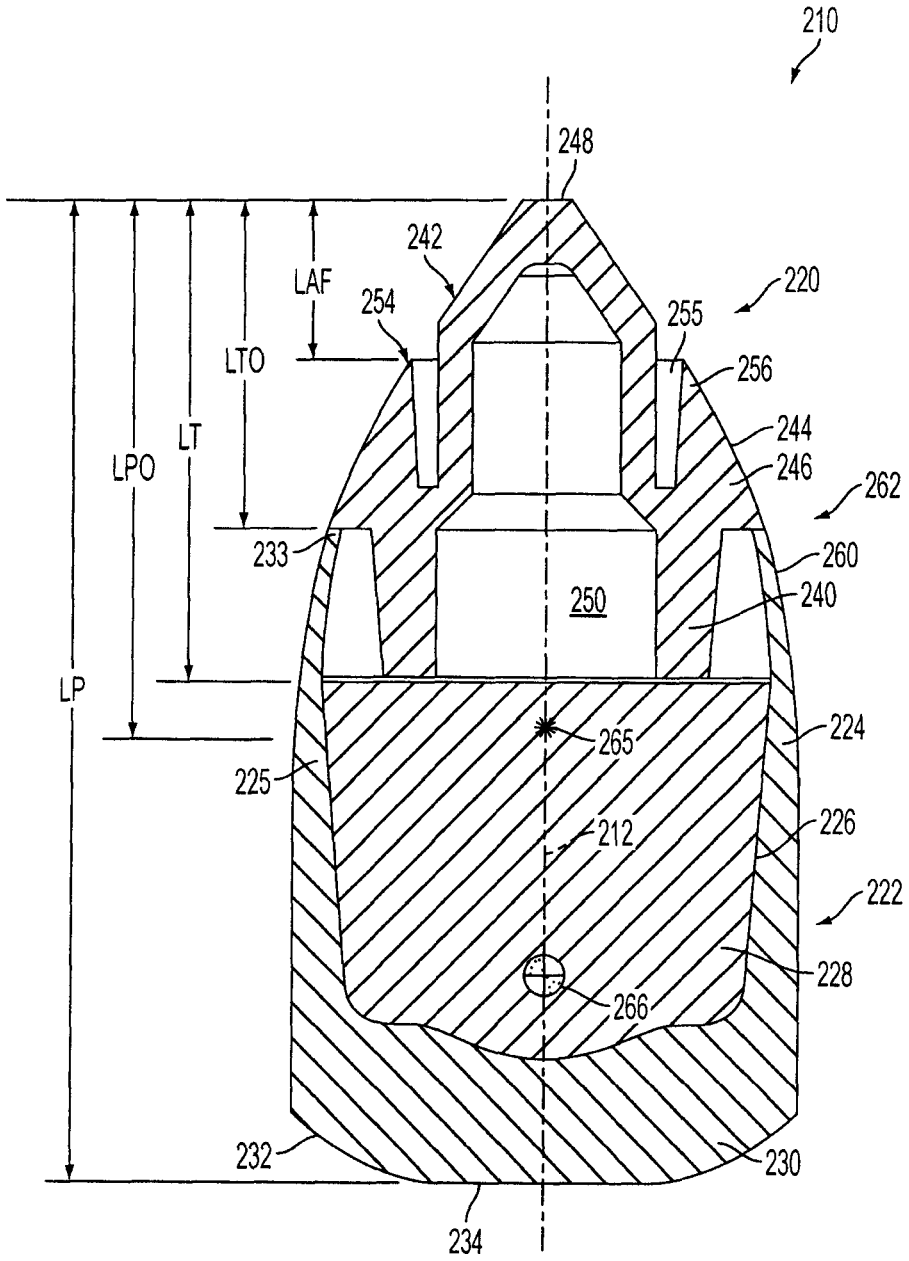
FIG. 5 is a cross sectional view of a projectile according to a second embodiment of the invention.
Figure 6:
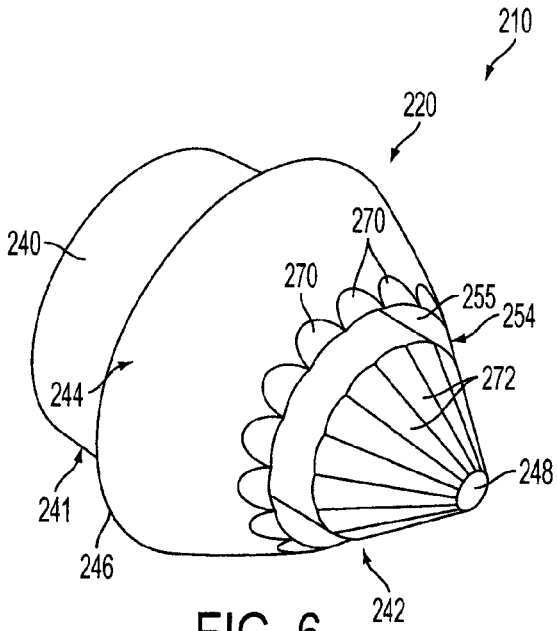
FIG. 6 is a perspective view of the tip of the projectile according to the embodiment of FIG. 5, separate from the projectile jacket.

FIGS. 5-6 illustrate another embodiment of the projectile 210 according to the principles of the present invention. FIG. 5 is a cross sectional view of the projectile 210, which comprises a tip 220 mounted in a jacket 222. The projectile 210 may be axisymmetric or substantially axisymmetric about a longitudinal axis 212. As in the previous embodiment, the jacket 222 can be formed from a metal or metal alloy such as copper and can have a generally annular body 224 having a cylindrical side wall 225 that in part defines an interior cavity 226. The interior cavity 226 can be wholly or partially filled with, for example, a projectile core 228 formed of a dense material. The rear of the jacket 222 can have a base 230 with a curved ogive rear peripheral contour 232 and a flat end surface 234.

The tip 220 has an axisymmetric body 239 having a stem 240 projecting from its first or rear end portion 241 with a rim 246 found thereabout and received within a front portion of the interior cavity 226 of the jacket 222, and a second end portion 242 that tapers toward a generally pointed tip that can include a substantially flat front edge 248. An ogival portion 244 of the tip 220 is defined between the first and second end portions 241/242 and that extends forward from the stem 240 to the flat front edge 248. The rear surface of the rim 246 abuts the forward edge 233 of the side wall 225 of the jacket 222. The stem 240 may be a hollow generally annular body, and can in part define an interior volume 250 that extends from the core 228 to the forward end of the tip 220. Aerodynamic features 254, here shown as including at least one annular recess 255 extends from a forward or upper edge 256 of the ogival portion 244 rearwardly into the body of the tip 220. The tip 220 can be held in place in the jacket 222 by deforming the jacket 222 inward against the tip, as discussed previously. The ogival portion 244 of the tip 220 along with a jacket ogival portion 260 of the jacket 222 generally comprise the entire ogive portion 262 of the projectile 210.

The tip 220 is configured to assist in tailoring the aerodynamic properties of the projectile 210. In the exemplary embodiment, the aerodynamic features affect the airflow across the tip and projectile and thus help tailor or manipulate the location of a center of pressure 265 (FIG. 1) for the projectile, relative to the center of gravity 266 of the projectile. As shown in FIG. 5, the center of gravity 266 of the projectile generally is located within the core 228, along the longitudinal axis 112 and toward the base 230 of the projectile jacket. By modifying the airflow passing over the tip, and thus the projectile, with the aerodynamic features, the center of pressure 265 of the projectile can be moved relative to the center of gravity of the projectile by a distance or length sufficient to help stabilize the projectile and resist tumbling in flight to improve the long range accuracy thereof. Additionally, the tip 220 has a length LT and an ogive tip length LTO, and the projectile 210 has a length LP and an ogive length LPO of the ogive portion 262, measured along the longitudinal axis 212 as discussed above with respect to the embodiment of FIGS. 1-4. According to one aspect of the invention, the ogive tip length LTO is more than one half the ogive axial length LPO of the projectile 210. The external features on the ogive cause the projectile 210 to behave in a more stable manner during flight, resulting in improved accuracy.

Figure 7A:
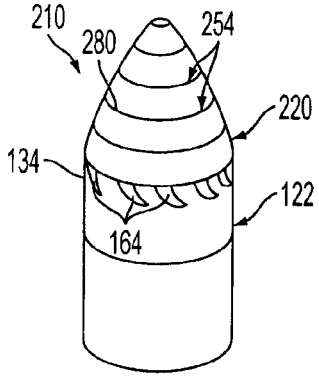
FIGS. 7A-7C are side elevational views illustrating additional alternative configurations of the tip of the projectile according to the principles of the invention.
Figure 7B:
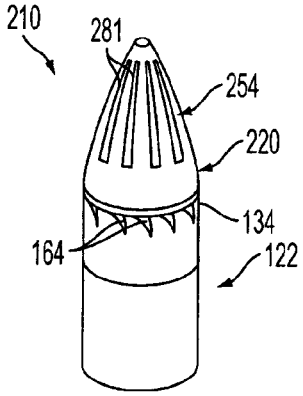
Figure 7C:
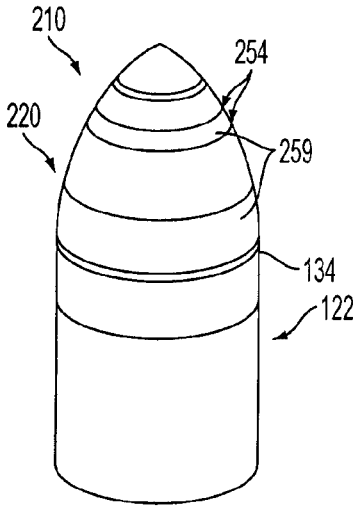

FIGS. 6-7C illustrate still further examples of various types of aerodynamic features 154/254 that can be formed in the tip. In one embodiment shown in FIG. 6, the tip 220 of FIG. 6 is shown separate from the jacket 222, and includes scalloped cuts or openings spaced in series about the upper end of the tip 220 at one or more locations 270 and/or a series of flats or ribs, shown at 272 extending along the upper end portion 242 from recess 255 to the flat front edge thereof. As shown in FIGS. 7A-7C, the aerodynamic features 154/254 further can include various openings, notches or cuts, including a spiral or helical cut 280 (FIG. 7A), slits or slots 281 (FIG. 7B), spaced concentric cuts, rings or recesses 282 (FIG. 7C), or a variety of other features or openings affecting the air flow over and about the tip, for modifying the flight of the tip and thus the projectile in operation to provide enhanced aerodynamics and accuracy of the projectile.

The tip for a projectile, such as a shotgun slug or other projectile, thus provides improved aerodynamic properties that can enhance accuracy of the projectile. The tip of the current invention has been shown to improve accuracy of shotgun slugs. Live fire testing and aerodynamic simulation software indicate shotgun slugs often are difficult to stabilize, which is a requirement of consistently good accuracy. Typical shotgun slugs can provide 2.5"-4.5" average extreme spread for 3, 5 shot groups at 100 yards, while an embodiment of the present invention as tested has been found to allow for groups as small as 1.6".

It will be understood by those skilled in the art that while the present invention has been discussed above with reference to preferred embodiments, various additions, modifications, and variations can be made thereto without departing from the spirit and scope of the present invention.

What is claimed:

1. A projectile for a round of ammunition, comprising:

a projectile body; and a tip formed from a material of a lighter weight than a material from which the projectile body is formed and having a base at least partially received within an upper end of the projectile body, a generally pointed front end, a tip body defining a tip ogival portion, and a series of aerodynamic features formed at selected locations about the tip ogival portion and spaced rearwardly from the front end of the tip to adjust a location of a center of pressure of the projectile body with respect to a center of gravity of the projectile body to enhance stability of the projectile body during flight from a firearm; and wherein an ogive tip length is defined between the upper end of the projectile body and the front end of the tip, and wherein the tip and the projectile body are nonreleaseably connected.

2. The projectile of claim 1 and wherein the aerodynamic features comprise a series of ports arranged in spaced series about the tip body.

3. The projectile of claim 2 and wherein the ports include at least 2 ports extending from an opening adjacent the front end of the tip inwardly along the tip body and into an interior chamber within the tip body.

4. The projectile of claim 1 and wherein the aerodynamic features comprise slots, cuts, notches or openings formed in spaced series about the tip body.

5. The projectile of claim 1 and wherein the tip comprises a plastic, synthetic or a metal material.

6. The projectile of claim 1 and further comprising a core formed from a metal material received within the projectile body.

7. The projectile of claim 1 and wherein the ogive tip length is greater than ½ of an ogive axial length defined along a longitudinal axis for the projectile between the base and the front end of the tip.

8. The projectile of claim 1 and wherein the projectile body is formed from a metal or metal alloy material.

9. The projectile of claim 8 and wherein the metal or metal alloy material of the projectile body comprises copper, brass, lead or bismuth.

10. The projectile of claim 1 and wherein said tip has a tip length of about 0.4 to about 0.6 inches and the projectile has an overall length of about 0.75-1.5 inches.

11. The projectile of claim 1 and further comprising a plurality of spiral cuts formed about the upper end of the projectile body for attaching the tip body to the projectile body.

* * * * *